United States Patent [19]

Miyata et al.

[11] 4,413,024

[45] Nov. 1, 1983

[54] METHOD FOR CHEMICAL TREATMENT OF WOODS

[75] Inventors: Hideo Miyata, Shizuoka; Hitoshi Ishii, Yaizu, both of Japan

[73] Assignee: Fuji Kogyo Company, Limited, Shizuoka, Japan

[21] Appl. No.: 209,303

[22] Filed: Nov. 21, 1980

[30] Foreign Application Priority Data

Mar. 17, 1980 [JP] Japan ..... 55-34409
Aug. 28, 1980 [JP] Japan ..... 55-118778

[51] Int. Cl.[3] ..... B05D 1/18; B05D 3/12

[52] U.S. Cl. ..... 427/370; 427/297; 427/351; 427/377; 427/440

[58] Field of Search ..... 427/297, 298, 440, 441, 427/351, 370, 377

[56] References Cited

U.S. PATENT DOCUMENTS 2,382,374 8/1945 Wood ..... 427/440 X
2,668,779 2/1954 Herman ..... 427/297
3,460,979 8/1969 Giese et al. ..... 427/440 X
3,987,219 10/1976 Aruidsson ..... 427/297
4,127,686 11/1978 Motai ..... 427/297 X

*Primary Examiner*—Michael R. Lusignan
*Attorney, Agent, or Firm*—Browdy and Neimark

[57] ABSTRACT

Disclosed is a method for the chemical treatment of woods, which comprises introducing a chemical solution into a pressure vessel charged with wood so that the wood is entirely dipped in the chemical solution, heating the chemical solution to a temperature within the range not causing high temperature troubles in the wood, and elevating the pressure in the pressure vessel above the saturated steam pressure to cause the chemical solution to permeate into the wood.

According to this method, the chemical permeation treatment can be accomplished in a very short time at a low temperature not causing high temperature troubles in woods. Furthermore, the preliminary boiling treatment, which is indispensable in the conventional method, can be omitted.

8 Claims, 1 Drawing Figure

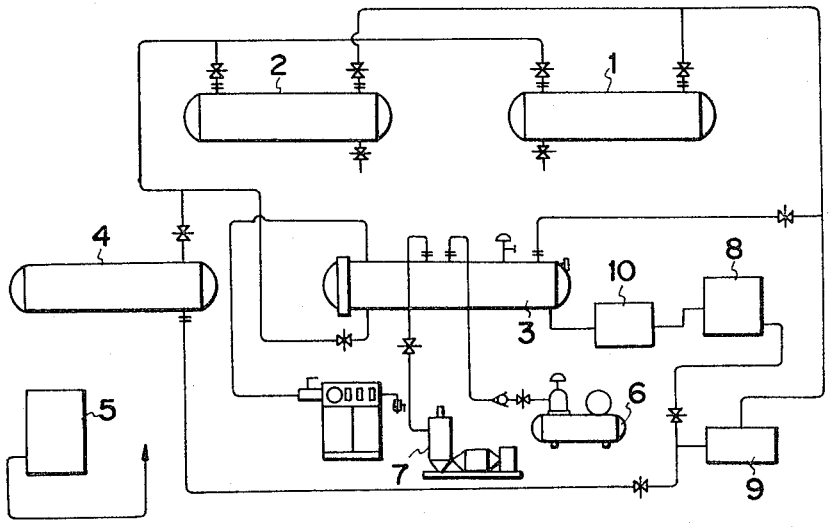
1
2
3
4
5
6
7
8
9
10

METHOD FOR CHEMICAL TREATMENT OF WOODS

BACKGROUND OF THE INVENTION (1) Field of the Invention

The present invention relates to a method for the chemical treatment of woods in which a treating solution of a warp-preventing chemical, a hardening agent, an insecticide or a wood preservative is heated at temperatures not causing high temperature troubles such as discoloration in wood and the heated treating solution is intruded promptly and uniformly into the wood under a pressure higher than the saturated vapor pressure.

(2) Description of the Prior Art

It is known that woods such as beech, oak, larch, pine, hemlock, lauan, kempas, red sandalwood, ebony, rosewood, apitong, kapor, monkeypot, walnut, maple and gum tree have been subjected to permeation treatments with aqueous solutions of surface active agents and dilute alkali solutions.

According to this known method, an aqueous solution of a surface active agent is charged in a boiling kettle and wood is dipped in this solution and boiled for 4 to 12 hours (the first step). The wood is then taken out from the kettle and transferred into a pressure vessel. A treating solution comprising an aqueous solution of a surface active agent and a dilute alkali solution is introduced into the pressure vessel and heat treatment is carried out under pressure for 8 to 9 hours while maintaining the treating solution at 120° to 130° C. and 2 to 2.75 Kgf/cm$^2$.a (1 to 2 Kgf/cm$^2$.a) with steam (the second step). Accordingly, in this known method, a very long time is required for completion of the treatment and much labor is necessary for transferring wood from the boiling kettle to the pressure vessel.

This defect is due to the fact that it had been considered that steam is the only means for permeation of the treating solution under heat and pressure.

More specifically, since woods have ordinarily poor heat resistance and the uppermost temperature not causing high temperature troubles such as discoloration is about 130° C., if pressurization is effected with steam while maintaining the temperature of the treating solution at a level not exceeding 130° C., it is impossible to elevate the pressure above about 2.75 Kgf/cm$^2$.a, which is the saturated steam pressure at 130° C.

If the temperature is controlled within the range not causing high temperature troubles, the heat resistance of woods is satisfactory, but the pressure cannot be elevated above the low level of about 2.75 Kgf/cm$^2$.a. Therefore, a considerably long time is required for the treating solution to permeate into the interior of wood.

When wood is charged in the pressure vessel from the start of the treatment and the treating solution is heated and pressurized by steam, not only the treating solution but also the wood per se will be heated. Accordingly, in this case, the heating time is extremely prolonged. Therefore, in the conventional method, in order to shorten the heating time in the pressure vessel, the boiling treatment which hardly attains any permeating effect is carried out at the first step so as to elevate the temperature of the wood.

In the conventional method, even if a large quantity of steam is supplied to the pressure vessel, it is impossible to elevate the pressure of the treating solution above 1 atmosphere while the temperature is still lower than 100° C., and in this case, the steaming step is nothing but a heating step and it is impossible to cause the treating solution to permeate under pressure into the wood. This is another fatal defect of the conventional method.

When the temperature of the treating solution is elevated to a predetermined level by steam supplied into the pressure vessel, even if the surface portion of wood is heated at a temperature substantially equal to the temperature of the treating solution, the temperature of the interior portion of wood is still low. Accordingly, the temperature of the treating solution is lowered and supplied steam is steadily liquefied. Furthermore, even while the solution temperature and pressure are maintained at predetermined levels, steam is liquefied. Accordingly, the concentration of the treating solution is drastically reduced and the intended chemical treating effect cannot be attained satisfactorily. This is still another defect of the conventional method.

SUMMARY OF THE INVENTION

The present inventors have researched with a view to eliminating and overcoming the above defects involved in the known method for the chemical treatment of woods, and have found that if the pressure in the pressure vessel is increased not by a steam pressure but by air pressure or the pressure of a chemical solution, at a relatively high temperature within the range not causing high temperature troubles or during the course of elevating the temperature to this level, a high pressure can be applied to a treating chemical solution irrespective of the saturated steam pressure. More specifically, it was found that when pressurization of a treating chemical solution is effected with air pressure or by means of a pressure pump or the like, even if the temperature is in the range where pressurization with steam is impossible, for example, 80° to 100° C., or if the temperature is still in the range providing a very low saturated steam pressure, for example, 100° to 110° C., a high pressure can be freely applied to the treating solution, with the result that the first step of the conventional method can be omitted and the time required for permeation of the treating solution into the wood under pressure can be remarkably shortened.

It has also been found that if compressed air is supplied into the pressure vessel in the state where an empty space of a small volume is left in the upper portion of the pressure vessel, the pressure in the pressure vessel can be promptly elevated and air compressed at a high pressure can be used for recycling the treating chemical solution.

Furthermore, it was found that when a treating chemical solution is fed under pressure into a pressure vessel by a pump, the inner pressure of the pressure vessel can be elevated more promptly and supplementary supply of the treating chemical solution can be performed simultaneously with the step of feeding the treating chemical solution under pressure. In this case, moreover, it is possible to precisely know the amount of the treating chemical solution permeated the wood from the amount of the treating chemical solution fed under pressure by the pump. Still further, this pressurization is safer than air pressurization.

The present invention has now been completed base on these findings.

More specifically, in accordance with the present invention, there is provided a method for the chemical treatment of woods, which comprises introducing a chemical solution into a pressure vessel charged with wood so that the wood is entirely dipped in the chemical solution, heating the chemical solution to a temperature within the range not causing high temperature troubles in the wood, and elevating the pressure in the pressure vessel above the saturated steam pressure to cause the chemical solution to permeate into the wood.

BRIEF DESCRIPTION OF THE FIGURE

The FIGURE shows a flow sheet of one embodiment of the method of the present invention.

DETAILED DESCRIPTION OF THE PREFERRED EMBODIMENTS

The present invention will now be described in detail.

In the present invention, the above-mentioned various woods and other woods used for construction and carpentry can be treated in the form of material woods or sawed woods such as rectangular timbers and planks. As the chemical that is used in the present invention, there can be mentioned, for example, a modifier for preventing warping of wood or bleeding of resin components to the surface, a wood preservative, an insecticide, a dye, a deodorant and a moisture absorption-preventing agent.

The chemical treatment according to the present invention will now be described with reference to the accompanying FIGURE.

When a modifying treatment for preventing warping is carried out, in a chemical tank, a surface active agent and a dilute alkali are dissolved in water so that the concentration of each chemical is 2%, and the solution is introduced into storage tanks 1 and 2 and is heated at about 80° C. by steam or electric heating.

Wood is charged into a pressure vessel 3, and the treating solution heated in the storage tank 1 is introduced into the pressure vessel 3. In case of air pressurization, the solution is fed so that the wood is entirely dipped in the treating solution and an empty air space occupying 5 to 30% of the diameter of the pressure vessel, preferably 5 to 10% of the diameter of the pressure vessel, is left in the upper portion of the pressure vessel 3. When the solution is supplied by a pump or when the solution is filled in the tank 3 completely, since the wood introduced into the pressure vessel 3 is kept at normal temperatures, the temperature of the treating solution is lowered to 65° to 70° C., though this temperature differs to some extent depending on the season or latitude.

Then, the temperature of the treating solution in the pressure vessel is elevated to a level not causing high temperature troubles, for example, 80° to 130° C. This heating is accomplished by supplying raw steam into the pressure vessel, feeding heated steam into a coil pipe disposed meanderingly in the bottom portion of the pressure vessel, supplying an electric current to an electric heater or by supplying heated steam to the above-mentioned coil pipe while introducing raw steam into the pressure vessel. Then, compressed air or treating solution is introduced under pressure into the pressure vessel to elevate the pressure.

When the treatment is carried out at 80° to 100° C. which is much lower than the uppermost critical temperature not causing high temperature troubles in the wood to be treated and at which pressurization with steam is impossible, a steam valve is closed to stop introduction of raw steam, and while the treating solution is heated at the above temperature by feeding heated steam into the coil pipe or by electric heating, compressed air is fed into the pressure vessel from a compressor or a treating chemical solution is fed under pressure by the pump at normal temperatures, whereby the inner pressure of the pressure vessel can be elevated to an optional level irrespectively of the saturated steam pressure.

Furthermore, when the treating chemical solution is permeated into the wood under pressure by compressed air, since the volume of the empty air space in the pressure vessel is much smaller than the inner volume of the pressure vessel, the inner pressure of the pressure vessel can be promptly elevated irrespectively of the temperature of the treating solution, with the result that the time required for pressurization and permeation of the treating solution can be remarkably shortened.

When the treating solution in the chemical tank is fed to the pressure vessel under pressure by the pump to cause the treating solution to permeate into the wood, even if the treating solution is maintained at a relatively low temperature, for example, at a normal temperature to 80° C., the treating solution can be supplied under pressure by using a cheap ordinary pump without reduction of the capacity thereof, and an expensive pump, such as a high temperature pump, need not be used.

According to this embodiment where the treating chemical solution is fed under pressure, the pressure in the pressure vessel can be increased to a high level just after the start of feeding of the chemical solution under pressure, and therefore, the time required for permeation of the treating chemical solution can be further shortened.

Since this step of increasing the inner pressure of the pressure vessel by air pressurization or feeding of the chemical solution under pressure is conducted without introduction of raw steam into the pressure vessel while heating the chemical solution by introducing heated steam into the coil pipe or by electric heating, liquefaction of steam and dilution of the treating solution can be prevented and a high treatment effect can be maintained without any reduction of the treatment effect due to reduction of the concentration of the chemical.

When the treating chemical solution containing a modifier, which is heated at 80° to 130° C., is pressurized by an air pressure, the treating solution is allowed to permeate into the very interior of the wood promptly and uniformly, and simultaneously, the temperature of the wood is elevated and substances causing warping, such as resins, lignins and hemicelluloses and wastes contained in trachea, tracheid and internal holes are promptly dissolved, molten and extraction. Furthermore, even if some of these substances are left in the wood, they are uniformly distributed in respective parts of the wood and warping of the wood can be prevented.

Then, in case of air pressurization, a valve disposed between the storage tank 1 which has become empty and the pressure vessel 3 is opened, whereby the treating chemical solution is returned at a time to the storage tank 1 by the action of compressed air present above the treating solution in the pressure vessel 3. If the storage tank 1 is located below the pressure vessel 3, the solution is returned by gravity. After the temperature of the wood has been lowered to an appropriate level, the wood is taken out from the pressure vessel and it is dried according to customary procedures.

The time required for the treatment of permeation of the modifier solution into the wood is ordinarily 2 to 4 hours, though this time differs to some extent according to the kind, water content and temperature of wood to be treated, and it has been confirmed that the treatment time required for the entire process including the steps of charging wood and withdrawing treated wood is about 2.5 to about 4.5 hours. When this modifier treatment is carried out repeatedly, the treating solution is charged in two storage tanks 1 and 2, and the treating solution is supplied to the pressure vessel 1 alternately from the storage tanks 1 and 2. Thus, exchange of the spent solution with the fresh solution can be performed very reasonably.

When wood to be treated is sawed wood, if the inner pressure of the pressure vessel is not elevated to about 3.5 Kgf/cm$^2$g, the treating solution is hardly allowed to intrude between timbers or planks. When such sawed wood is surface-smoothened by planing and is then treated, since the contact faces adhere very closely to each other, intrusion of the treating solution becomes more difficult. Accordingly, in this case, it is preferred that the inner pressure of the pressure vessel be elevated to at least 4 Kgf/cm$^2$g.

The permeation speed of the treating solution is elevated with increase of the pressure, but the ratio of increase of the permeation speed is gradually reduced as the applied pressure is further enhanced. Furthermore, the manufacturing cost of a pressure vessel having an extremely high pressure resistance is large. Therefore, it is preferred that the upper limit of the inner pressure in the vessel pressure 3 be up to about 45 Kgf/cm$^2$g.

In the present invention, even when various kinds of woods or wood articles differing in size (such as planks, plates and rectangular timbers) are treated at one time in the pressure vessel 3, the treatment can be carried out advantageously at a high efficiency. More specifically, in this case, the temperature of the treating solution is maintained at a level not causing high temperature troubles in the wood having the lowest heat resistance, and an air pressure much higher than the saturated steam pressure at this solution temperature is applied. Thus, the permeation treatment can be accomplished very promptly without causing high temperature troubles.

An embodiment in which a treating solution containing a chemical improving the durability of wood such as a wood preservative or insecticide or a chemical improving the grade of wood such as a dye, deodorant or moisture absorption-preventing agent is intruded in the wood under pressure will now be described.

In case of a material wood in which the warping tendency is much less and a treatment with an aqueous solution of a surface active agent or a dilute alkali solution need not be conducted, untreated wood is charged in the pressure vessel 3, and as described above with respect to the first embodiment, a heated treating solution containing a wood preservative or insecticide is introduced from the storage tank 2 into the pressure vessel 3. The solution temperature is elevated to 80° to 130° C. by heating, and after or simultaneously with this heating, by compressed air or by feeding of the treating solution under pressure, the permeation treatment is carried out under 3 to 45 Kgf/cm$^2$g for about 15 to about 120 minutes to effect permeation of the treating solution. Then, the treating solution is discharged from the pressure vessel and the treated wood is withdrawn.

In case of a material wood in which warping is readily caused, after the modifying treatment has been carried out in the same manner as described hereinbefore, the modifying treatment solution (a solution of a mixture of a surface active agent and a dilute alkali) is returned to the storage tank 1 and a solution of a wood preservative, an insecticide or a mixture thereof, which is heated at about 80° C. in the storage tank 2, is introduced into the pressure vessel 3. Then, the temperature is elevated to 80° to 130° C. again and the pressure is elevated to 3 to 45 Kgf/cm$^2$g in the same manner as described above, whereby the treating solution is caused to permeate into the wood in a very short time (for example, 15 to 120 minutes).

In this case, even the interior of the wood is already heated to a high temperature by the modifying treatment, and therefore, reduction of the temperature of the treating solution of the wood preservative or insecticide is very small. Furthermore, the above-mentioned various substances contained in the wood, such as resins, have already been dissolved out and remaining portions of these substances are diluted with the modifying chemical solution and are uniformly distributed in the wood. The newly supplied treating solution of the wood preservative or insecticide is allowed to permeate into the interior of the wood uniformly in a very short time. Therefore, the permeation treatment of the second stage is accomplished in a very short time.

Then, the treating solution is returned to the storage tank 2, and the treated wood is withdrawn from the pressure vessel 1.

An appropriate dye is chosen according to the kind of wood to be treated and the intended use of treated wood. An agent capable of decomposing a smell-producing substance, such as a reducing agent or an oxidant, is used as the deodorant. A solution containing such dye or deodorant is caused to permeate into wood according to the same procedures as described above. In case of a hardening treatment, a plastic material is intruded into the surface portion of wood according to the same procedures as described above.

The above-mentioned treatments for improving the grade and quality of wood are advantageously conducted on sawed woods or planed woods.

The present invention will now be described in detail with reference to the following Examples that by no means limit the scope of the invention.

EXAMPLE 1

(1) Preparation of Treating Solution

City water is stored in the chemical tank 8 and heated at 60° to 80° C. by passing heated steam through a pipe arranged in the tank 8. Then, an anionic activating agent as the surface active agent (such as known sodium dodecylbenzene-sulfonate) and soda ash as the alkali are incorporated into the heated water so that the concentration of each chemical is 0.2%. The mixture is stirred and the so formed treating solution is charged into the storage tanks 1 and 2 shown in the drawings by means of a pump 9. The amount of the treating solution charged in each tank was 15 m$^3$. Then, the treating solution is heated to 80° to 95° C. by heated steam fed through a steam pipe in the tank from a boiler 5.

(2) Charging of Wood

Ocean maple planks having a length of 3000 mm, a width of 115, 250 or 300 mm and a thickness of 18, 36, 42 or 90 mm and beech planks having a length of 300 mm, a width of 115, 250 or 300 mm and a thickness of 26 or 36 mm, which have been carried by a truck, are charged into the pressure vessel 3, and a lid at the opening of the pressure vessel 3 is shut.

(3) Charging, Heating and Pressurization of Treating Solution

[Pre-Treatment]

The treating solution in the storage tank 1 is introduced into the pressure vessel 3 so that the planks are completely dipped in the treating solution and an empty air space occupying 10% of the diameter of the pressure vessel 3 is left in the upper portion of the pressure vessel 3. At this point, since the planks have been kept at normal temperatures, the liquid temperature is lowered to 65° to 70° C. Accordingly, heated steam from the boiler 5 is passed through a pipe arranged in a zigzag manner in the bottom portion of the pressure vessel 3 to heat the treating solution at 70° to 80° C. Simultaneously, compressed air is introduced under pressure in the empty air space in the upper portion of the pressure vessel 3 from an air compressor 6. In this state, the pre-treatmemt is carried out under a pressure of 9.9 Kgf/cm$^2$g for 60 to 120 minutes.

[Treatment]

After the above-mentioned pre-treatment, heating and pressurization are further carried out at a liquid temperature of 110° to 114° C. under an air pressure of 9.9 Kgf/cm$^2$g for 30 minutes (thin planks) to 120 minutes (thick planks). In case of gum wood, the treatment temperature is elevated to 115° to 120° C.

(4) Return of Treating Solution

When a liquid discharge valve of the pressure vessel 3 is opened, compressed air of 9.9 Kgf/cm$^2$g pressed in the upper portion of the pressure vessel 3 is imposed on about 11 m$^3$ of the treating solution to cause it to return to the store tank 1 over a period of 7 minutes.

(5) Post Treatment

The pressure vessel 3 is sealed and evacuated by a vacuum pump 7 and the vacuum state is maintained at 500 mmHg for 20 to 40 minutes. By this treatment, the wood temperature is lowered to about 90° C. from 110° to 120° C., and the water content is reduced to about 40%.

The treating solution left in the bottom portion of the pressure vessel 3 is withdrawn by the pressure of compressed air from the compressor 6, and atmospheric pressure is maintained in the pressure vessel 3 for 30 minutes and the treated planks are then withdrawn from the pressure vessel 3.

When this modifying treatment is carried out repeatedly, the storage tanks 1 and 2 are used alternately and the treating solution is heated at a predetermined liquid temperature.

When the so treated wood is subsequently subjected to a treatment with a solution of an insecticide, a wood preservative, a deodorant, a surface hardening agent or a dye, different treating solutions are stored in the storage tanks 1, 2 and 4, respectively, and after withdrawal of the residual treating solution in the above-mentioned treatment process, the subsequent treating solution is introduced into the pressure vessel 3 and the heat treatment under pressure is carried out in the same manner as described above.

EXAMPLE 2

Preparation (1) of a treating solution and charging (2) of wood are carried out in the same manner as described in Example 1, and then, the following treatments are conducted.

(3) Charging of Treating Solution, Heating and Pressurization

[Pre-Treatment]

The treating solution in the storage tank 1 is filled in the pressure vessel 3 completely, and the valve is closed. Since the wood is maintained at normal temperatures, the temperature of the treating solution is reduced to 65° to 70° C. Accordingly, the treating solution is heated at 70° to 80° C. by passing heated steam through a pipe laid out in a zigzag manner in the bottom of the pressure vessel 3. Simultaneously, the treating solution in the chemical tank 8 is fed under pressure into the pressure vessel 3 by a plunger pump 10 to elevate the pressure in the pressure vessel 3 to 9.9 Kgf/cm$^2$g, and the pre-treatment is conducted in this state for 60 to 120 minutes.

[Treatment]

Heating and pressurization are conducted at a liquid temperature of 110° to 115° C. for 30 minutes (thin planks) to 120 minutes (thick boards) while maintaining the inner pressure of the pressure vessel at 9.8 Kgf/cm$^2$g.

(4) Return of Treating Solution

The liquid discharge valve of the pressure vessel 3 is opened, and simultaneously, compressed air from the compressor 6 is fed into the pressure vessel 3 from the upper portion thereof to cause the treating solution to return to the store tank 1. The post treatment is then carried out in the same manner as described in Example 1.

What is claimed is:

1. A method of treating timber with chemicals, comprising the steps of:

introducing into a pressure vessel, in which timber has been placed, such an amount of a solution of chemicals that permits all of the timber to be soaked therein, with an empty space of a small height in an upper portion of the interior of the pressure vessel;

heating the timber and solution of chemicals in the pressure vessel to a temperature which is not less than about 100° C., and no higher than that temperature at which high-temperature trouble, such as discoloration, begins to occur on the timber; and pneumatically increasing the pressure in said empty space in the upper portion of the interior of the pressure vessel to a level greater than that of the pressure of saturated steam at that temperature to which said timber and solution are heated in said heating step, to allow the chemicals to be permeated into the timber.

2. A method according to claim 1, wherein the timber and solution of chemicals is heated in said heating step by means of steam.

3. A chemical treatment according to claim 1, wherein the treating chemical solution is an aqueous solution containing a surface active agent and a dilute alkali.

4. A chemical treatment method according to claim 1, wherein the treating chemical solution is a solution of a wood preservative, an insecticide or a mixture thereof.

5. A chemical treatment method according to claim 1, wherein the treating chemical solution is introduced into the pressure vessel so that an empty air space occupying 5 to 30% of the diameter of the pressure vessel is left in the upper portion of the pressure vessel and compressed air is introduced under pressure into said empty air space above the liquid level of the treating chemical solution.

6. A chemical treatment method according to claim 1, wherein a storage tank provided with heating means is arranged in parallel to the pressure vessel, and the treating chemical solution is heated in said storage tank and is then introduced into the pressure vessel.

7. A chemical treatment method according to claim 1, wherein a plurality of storage tanks are arranged in parallel to the pressure vessel, and chemical treating solutions are stored in said storage tanks and the chemical treating solutions are introduced into the pressure vessel alternately from said storage tanks.

8. A chemical treatment method according to claim 1, wherein different kinds of woods are charged in the pressure vessel and the chemical solution is heated at a temperature not causing high temperature troubles in the wood having the lowest heat resistance.

* * * * *